US009987765B2

(12) United States Patent
Lee Lum

(10) Patent No.: US 9,987,765 B2
(45) Date of Patent: Jun. 5, 2018

(54) VENTILATED BUILDING BLOCK AND RELATED MOLD COMPONENTS

(71) Applicant: Mark E. Lee Lum, Maraval (TT)

(72) Inventor: Mark E. Lee Lum, Maraval (TT)

( * ) Notice: Subject to any disclaimer, the term of this patent is extended or adjusted under 35 U.S.C. 154(b) by 0 days. days.

(21) Appl. No.: 14/917,123

(22) PCT Filed: Sep. 16, 2014

(86) PCT No.: PCT/IB2014/002044

§ 371 (c)(1),
(2) Date: Mar. 7, 2016

(87) PCT Pub. No.: WO2015/036859

PCT Pub. Date: Mar. 19, 2015

(65) Prior Publication Data

US 2016/0207219 A1 Jul. 21, 2016

Related U.S. Application Data

(60) Provisional application No. 61/878,294, filed on Sep. 16, 2013.

(51) Int. Cl.
*B28B 7/00* (2006.01)
*B28B 7/24* (2006.01)
(Continued)

(52) U.S. Cl.
CPC ..... *B28B 7/0097* (2013.01); *B28B 7/24* (2013.01); *B28B 15/005* (2013.01); *E04C 1/392* (2013.01)

(58) Field of Classification Search
CPC ..... B28B 7/0097; B28B 7/24; B28B 15/005; E04B 1/7076; E04C 1/392; E04H 17/1404; F24F 2007/003
(Continued)

(56) References Cited

U.S. PATENT DOCUMENTS 744,970 A * 11/1903 Miller ..... B28B 7/168 164/391
795,518 A * 7/1905 Lamp ..... B28B 7/0017 249/139
(Continued)

FOREIGN PATENT DOCUMENTS

DE 84 34 290 1/1985
DE 10 2004 063 479 7/2006
(Continued)

OTHER PUBLICATIONS

PCT International Search Report dated Mar. 23, 2015 issued in PCT International Patent Application No. PCT/IB2014/002044, 1 page.
(Continued)

*Primary Examiner* — Brian E Glessner
*Assistant Examiner* — Adam G Barlow
(74) *Attorney, Agent, or Firm* — Nixon & Vanderhye P.C.

(57) ABSTRACT

A mold assembly is used for manufacturing a ventilated building block. The ventilated building blocks are configured such that adjacent stacked blocks are inverted and reversed, thereby establishing front-to-back air passages that do not provide a sight line and prevent rain from passing through while enabling air ventilation.

13 Claims, 13 Drawing Sheets

(51) Int. Cl.
*B28B 15/00* (2006.01)
*E04C 1/39* (2006.01)

(58) Field of Classification Search
USPC ... 52/302.1, 302.4, 503, 504, 574, 604, 607, 52/606, 608, 609; 249/63, 66.1; 264/334, 336; 425/436 R, 444, 456, 458, 425/468, 469, 577
See application file for complete search history.

(56) References Cited

U.S. PATENT DOCUMENTS 1,570,998 A * 1/1926 Egger ..... B28B 23/028 249/126
1,758,757 A 5/1930 Niemann
2,137,153 A 11/1938 Brozek
2,298,006 A * 10/1942 George ..... B28B 23/028 425/443
2,624,193 A 1/1953 Larson
2,636,242 A * 4/1953 Lindman ..... B28B 1/087 425/410
2,667,679 A * 2/1954 Jackman ..... B28B 3/022 264/69
2,859,502 A * 11/1958 Brown, Jr. ..... B28B 3/022 425/139
2,934,807 A * 5/1960 Donati ..... B28B 7/0097 264/333
3,981,953 A * 9/1976 Haines ..... B28B 3/02 264/163
4,307,866 A * 12/1981 Brown ..... B29C 45/36 249/63
4,756,865 A * 7/1988 von Holdt ..... B29C 45/33 264/334
4,823,530 A 4/1989 Haring
5,062,610 A * 11/1991 Woolford ..... B28B 7/0097 249/119
5,249,950 A * 10/1993 Woolford ..... B28B 7/42 100/218
5,297,772 A * 3/1994 Stefanick ..... B28B 7/0014 249/102
5,817,248 A * 10/1998 Forlini ..... B28B 7/0044 249/102
5,943,827 A * 8/1999 Okerlund ..... E04C 1/395 362/147
6,108,995 A * 8/2000 Bouchard ..... E02D 29/025 52/284
7,096,634 B2 8/2006 Dean, Jr.
7,757,451 B2 * 7/2010 Lee Lum ..... E04C 1/392 52/302.4
7,980,842 B2 * 7/2011 Ness ..... B28B 7/0041 425/143
2006/0145050 A1 * 7/2006 Price ..... B28B 7/0064 249/160
2010/0223868 A1 9/2010 Lee Lum
2010/0242390 A1 * 9/2010 Lee Lum ..... E02D 29/025 52/302.1
2011/0198051 A1 * 8/2011 Yoshiara ..... B22C 9/101 164/137
2013/0106022 A1 * 5/2013 Gridley ..... B29C 37/0007 264/334
2016/0090740 A1 * 3/2016 Giarritta ..... B29D 99/0021 52/606

FOREIGN PATENT DOCUMENTS

GB 782754 9/1957
JP 2007-320131 12/2007

OTHER PUBLICATIONS

Japanese Office Action dated Apr. 18, 2017 issued in Japanese Patent Application No. 2016-542394 and English translation, 6 pp.
German Office Action dated Sep. 18, 2017 issued in German Patent Application No. 11 2009 003 535.3 and English translation, 15 pp.

* cited by examiner

VENTILATED BUILDING BLOCK AND RELATED MOLD COMPONENTS

CROSS-REFERENCES TO RELATED APPLICATIONS

This application is the U.S. national phase of International Application No. PCT/IB2014/002044 filed Sep. 16, 2014 which designated the U.S. and claims priority to U.S. Provisional Patent Application No. 61/878,294 filed Sep. 16, 2013, the entire contents of each of which are hereby incorporated by reference.

BACKGROUND OF THE INVENTION

The present invention relates to a ventilated building block construction and to mold components for a machine for making the block.

Currently, typical concrete ventilating blocks are formed with straight, internal passages extending vertically through the block, such that when plural blocks are stacked, a ventilating "chimney" is formed. These and other block constructions are well represented in the patent literature. For example, U.S. Pat. No. 2,137,153 discloses ventilated wall blocks that are stacked vertically in an alternately inverted orientation, establishing both vertical and horizontal vent passageways. In U.S. Pat. No. 7,096,634, a block is disclosed that, when stacked, creates vertical vents or cores. Still other block constructions are disclosed in U.S. Pat. Nos. 1,758,757; 2,624,193; and 4,823,530. A ventilated building block and mold core and stripper shoe components for forming the ventilated building block are described in a commonly-owned U.S. Pat. No. 7,757,451, the entirety of which is incorporated herein by reference.

The block described in the '451 patent includes an elongated center portion flanked by a pair of substantially parallel side walls oriented substantially perpendicularly to the center portion, the center portion having a first vertical wall and a second sloped wall. The sloped wall extends between a relatively thicker bottom wall of the center portion and a relatively thinner top wall. A horizontal shoulder extends across the sloped front wall at a height substantially equal to the height of the side walls, such that the shoulder lies in the same horizontal plane as the upper edges of the side walls. Accordingly, the upper portion of the block assumes a substantially triangular cross-sectional shape.

Another existing design is described in GB 782,754. The building blocks in the GB '754 patent are "precast" (as stated in the patent). Precast products are made by filling a mold with concrete and leaving it for a specific time (usually a minimum of 24 hours), or depending on the design of the item being precast, a couple of days, before stripping it from the mold. The GB '754 design would require anywhere from two to six days before stripping from the mold. The GB '754 design, however, cannot be manufactured on a conventional concrete block machine as the design requires an "upper" and a "lower" core block. The lower core block would prevent or make it impossible to strip the block from the mold as is done on a block machine.

BRIEF DESCRIPTION OF THE INVENTION

In accordance with an exemplary but nonlimiting embodiment of this invention, there is provided a modified ventilated building block along with mold core and stripper-shoe components for a block manufacturing machine for forming the modified ventilated building block. In the modified block, the upper portion of the block between and above the side walls now may have a substantially square cross-sectional shape. The sloped wall may alternatively have a consistent slope from bottom to top. Additionally, the horizontal shoulder has been eliminated to facilitate manufacture. Still further, the upper portion may be slightly inwardly offset from the side walls.

The design can advantageously be made on an automated concrete block machine that is configured to produce a block depending on its design in seconds, e.g. ten seconds per cycle. Also, because the concrete is compressed under vibration, the block can be five to ten times stronger than the precast unit. This additional strength is also achieved by using less cement (the most costly factor in concrete) than its precast counterpart.

In order to manufacture the modified block, new mold core and stripper shoe components are illustrated and described herein.

In an exemplary embodiment, a mold assembly provides for machine molding a ventilated building block. The building block is cooperable with an adjacent building block in a stacked, inverted and reversed orientation relative to the adjacent building block. The building block may include an elongated center portion flanked by a pair of substantially parallel side walls oriented substantially perpendicularly to the center portion. The center portion may project upwardly beyond upper edges of the side walls, and the side walls may extend forwardly of a forward edge of the center portion. The mold assembly includes an outside division plate delimiting one of a rearmost side and a forwardmost side of the building block and an inside division plate delimiting one of the rearmost side and the forwardmost side of the building block. A core block portion is disposed between the outside division plate and the inside division plate and delimits a sloped front surface of the elongated center portion. A plate portion cooperable with the core block portion and disposed spaced from the one of the outside division plate or the inside division plate delimits the rearmost side of the building block and delimits a thickness of the center portion where the center portion projects upwardly beyond the upper edges of the side walls. A pair of return flanges positioned on opposite lateral sides of the core block portion delimit a width of the center portion where the center portion projects upwardly beyond the upper edges of the side walls. A stripper shoe assembly disposed outside of and above the return flanges delimits the upper edges of the side walls and a height of the center portion.

The plate portion may extend laterally beyond opposite side edges of the core block portion.

The stripper shoe assembly may include a stripper bar positioned adjacent the core block portion and delimiting the height of the center portion, and blocks positioned at opposite lateral ends of the stripper bar and oriented relative to the stripper bar such that the stripper shoe assembly defines a U-shape. The blocks delimit the upper edges of the side walls. The mold may also include a plunger to which the stripper shoe assembly is bolted that is displaceable relative to the outside division plate and the inside division plate. In one arrangement, each of the blocks includes two discrete block elements separately attachable to an underside of the plunger. The stripper bar may include a planar plate member that is thinner than the blocks, where the bar is generally rectangular in cross-section.

The core block portion and the plate portion may be shaped and positioned relative to each other such that the sloped front surface of the elongated center portion transitions to a vertical wall portion substantially where the elongated center portion projects upwardly beyond the upper edges of the side walls. In another arrangement, the core block portion and the plate portion are shaped and positioned relative to each other such that the sloped front surface of the elongated center portion extends from a bottom of the elongated center portion to a top of the elongated center portion.

The return flanges may be positioned relative to the core block portion and the stripper shoe assembly such that the elongated center portion is offset inwardly from the side walls.

The mold assembly may also include a center division plate interposed between the outside division plate and the inside division plate that defines two mold chambers for concurrently molding two building blocks.

The inside division plate may delimit the other of the rearmost side and the forwardmost side of the building block.

In another exemplary embodiment, a ventilated building block is manufactured using the mold assembly according to the described embodiments.

In yet another exemplary embodiment, a method of manufacturing a ventilated building block using the mold assembly according to the described embodiments includes the steps of positioning and securing the mold assembly in a mold box; pouring a block material into the mold box; vibrating the mold box; compressing the block material with the stripper shoe assembly; and stripping the molded ventilated building block from the mold assembly with the stripper shoe assembly. The vibrating step and the compressing step may be performed concurrently.

In still another exemplary embodiment, a ventilated building block is cooperable with an adjacent building block in a stacked, inverted and reversed orientation relative to the adjacent building block. The ventilated building block includes an elongated center portion flanked by a pair of substantially parallel side walls oriented substantially perpendicularly to the center portion, where the center portion projects upwardly beyond upper edges of the side walls, and where the side walls extend forwardly of a forward edge of the center portion. The elongated center portion includes a sloped front face and a substantially vertical rear face, where the sloped front face is oriented at an initial angle relative to the substantially vertical rear face, with the initial angle being a maximum angle of the sloped front face relative to the substantially vertical rear face.

BRIEF DESCRIPTION OF THE DRAWINGS

The invention will now be described in detail in connection with the drawings identified below.

DETAILED DESCRIPTION OF THE PREFERRED EMBODIMENTS

Figure 1:
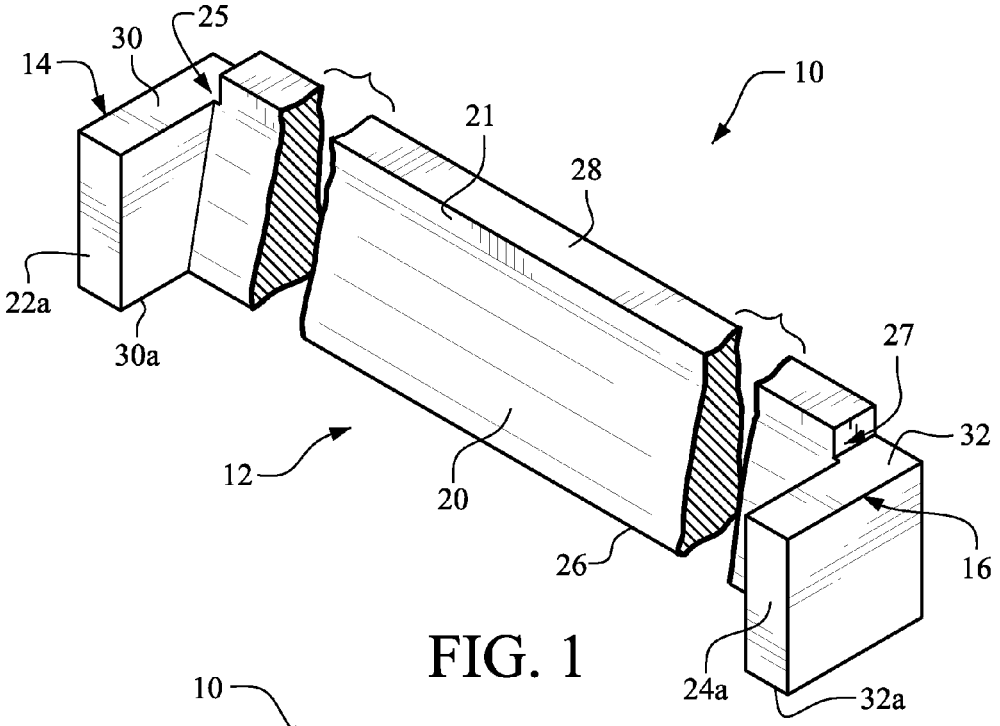
FIG. 1 is a front perspective view of a ventilated building block in accordance with an exemplary but nonlimiting embodiment of the invention.
Figure 2:
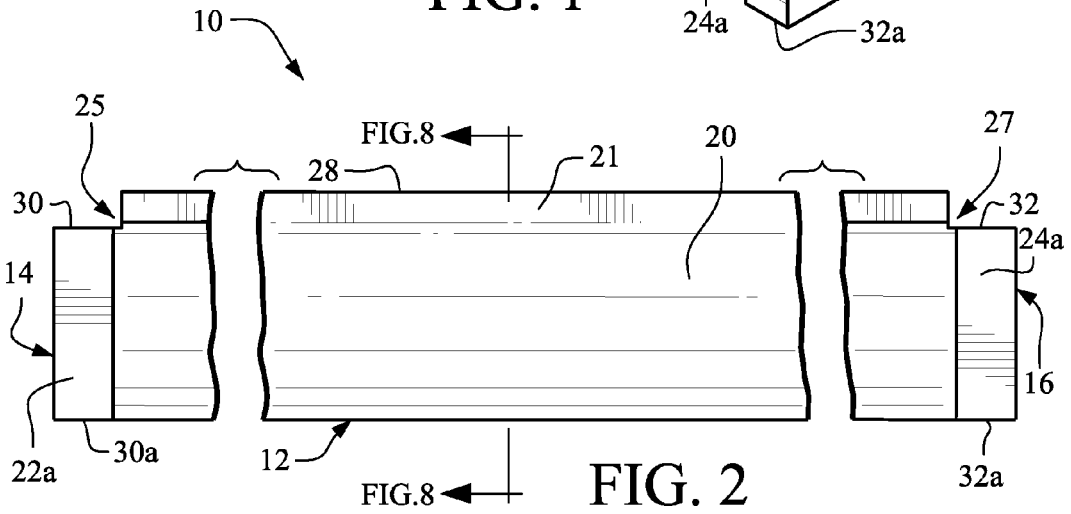
FIG. 2 is a front elevation view thereof.
Figure 3:
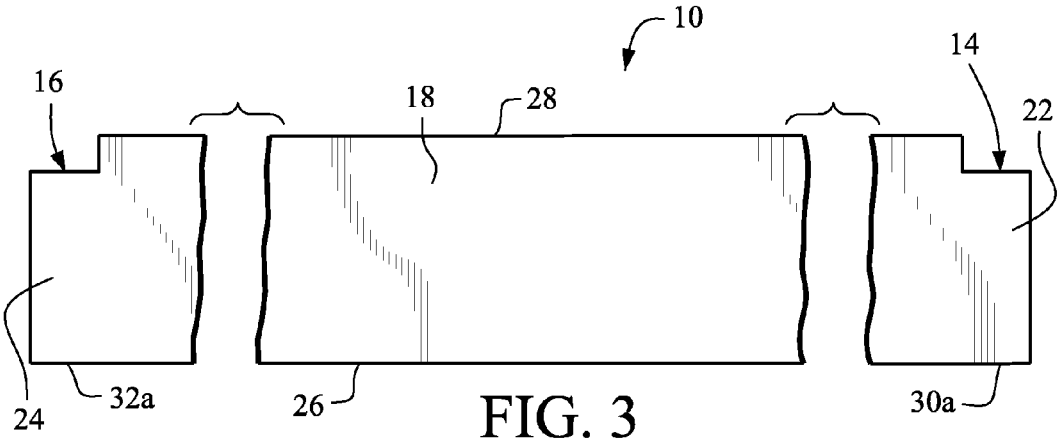
FIG. 3 is a rear elevation view thereof.
Figure 4:
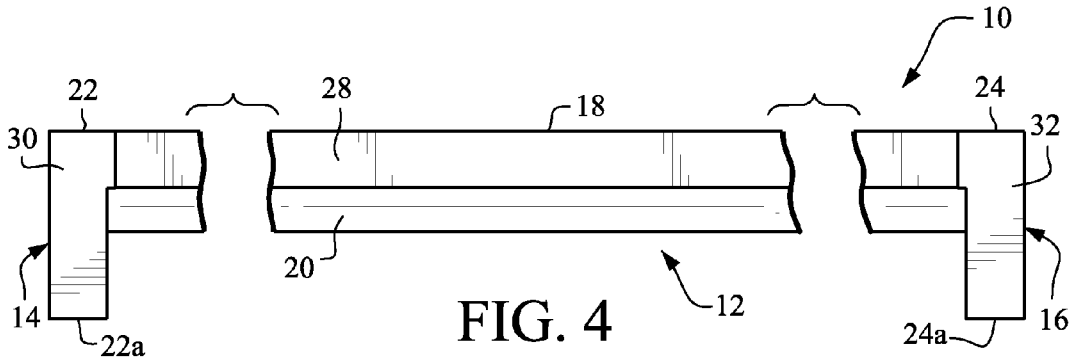
FIG. 4 is a top plan view thereof.
Figure 5:
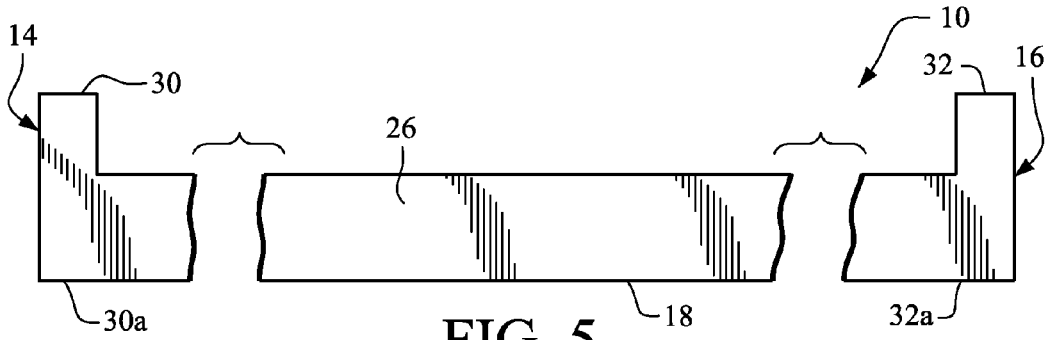
FIG. 5 is a bottom plan view thereof.
Figure 6:
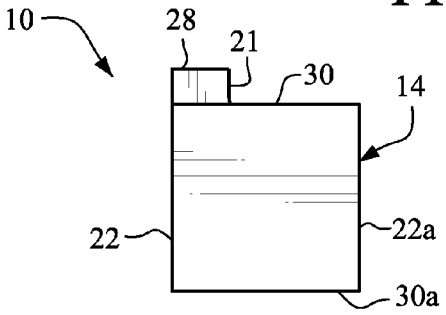
FIG. 6 is a left side elevation view thereof.
Figure 7:
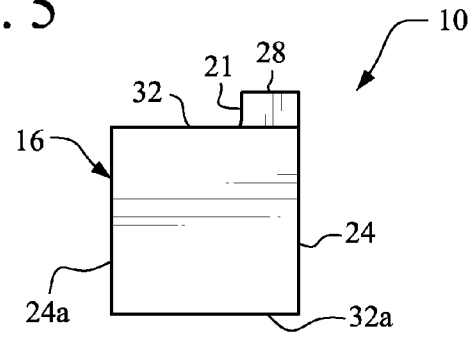
FIG. 7 is a right side elevation view thereof.
Figure 8:
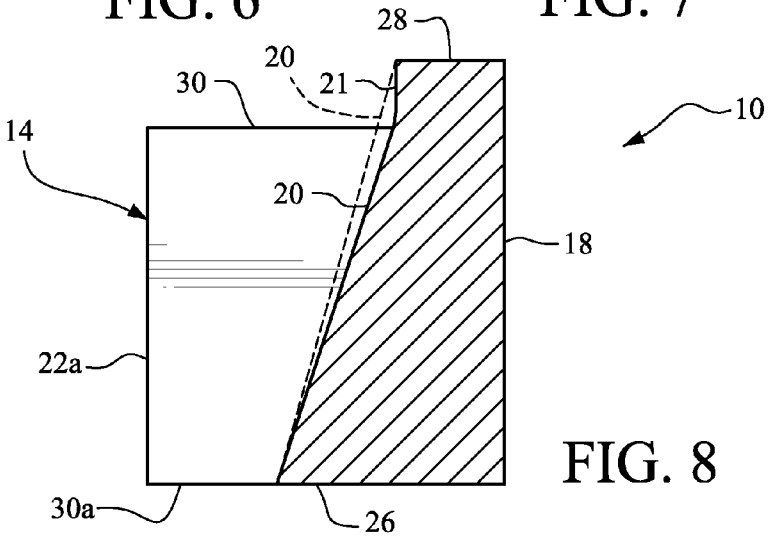
FIG. 8 is a section view taken along the line 8-8 in FIG. 2.

With reference initially to FIGS. 1-8, a block 10 is formed (e.g., molded) to include an elongated center portion 12 with a pair of side walls 14, 16 arranged at either end of the center portion, and substantially perpendicular thereto. For ease of understanding, the block will be described as having a front and a back, top and bottom but it will be appreciated that these terms are relative, and are not intended to be limiting in any respect. Thus, for example, in FIG. 1, the view of the block 10 may be regarded as a top, right, front perspective view, with FIGS. 2-8 described relative to FIG. 1. Accordingly, the reference to "top", "bottom", "front", "back", "left" and "right" refers to the block in FIG. 1, with its "front" side facing forward. It will be understood, however, that adjacent upper and lower blocks are reversed and inverted on assembly, so that the characterization of the block with reference to FIG. 1 is for convenience only.

The center portion 12 of the block has a flat, substantially vertical back wall or rear face 18 and a generally-sloped front wall portion or front face 20. The back wall 18 is flush or co-planar with back (or first) edges 22, 24 of the side walls 14, 16, respectively. The sloped front wall portion 20 extends between a relatively thicker bottom wall or base 26 to a relatively thinner top wall 28. In one embodiment, the sloped front wall transitions to a vertical wall portion 21 at approximately the upper edges 30, 32 of the side walls. In an alternative embodiment, the sloped front wall has a consistent slope from bottom to top (shown in dashed line in FIG. 8). Essentially, the sloped front wall portion 20 is oriented at an initial angle relative to the substantially vertical back wall 18, where the initial angle from bottom to top is a maximum angle of the sloped front face 20 relative to the substantially vertical rear face 18. The horizontal shelf or shoulder described in the '451 patent has thus been eliminated. In one embodiment, the vertical wall portion is offset inwardly from the side walls by a few millimeters (e.g. 2-4 mm on each side). The exemplary offsets are shown at 25, 27. The slope angle of the front wall portion 20 is preferably in the range of about 45-80° (shown at about 70° in FIG. 5, but the angle may vary with specific applications) relative to the horizontal bottom wall or base 26. The terms "thicker" and "thinner" in this context relate to the depth dimension of the block.

In this exemplary embodiment, the side walls 14, 16 extend beyond, i.e., forward of, the sloped front wall portion 20, and the lower (or third) edges 30*a* and 32*a* of the sidewalls are flush with the bottom wall or base 26.

In the exemplary but non-limiting implementation of the invention illustrated in FIGS. 1-8, the block 10 may have a length (from side to side) of between about 190 mm and 460 mm (for example about 390 mm) and a depth (from front to back) of between about 80 mm and 200 mm (for example, about 90 mm). The total height of the block (from bottom to top) may be between about 80 mm and 240 mm (for example, about 107 mm). In the example shown, the vertical wall portion 21 extends about 32 mm above the side wall edges 30, 32. The side wall thickness may be about 28 mm. The center portion 12 may have a depth of about 51 mm at the base 26 (in this embodiment, the forward or fourth edges 22*a*, 24*a* of the side walls 14, 16 are forward of the center portion), and a depth of about 27 mm at the top edge 28.

It will be understood that the dimensions of the block may vary uniformly by scale, or differentially, depending on specific applications. It will also be appreciated that the block may be constructed of any suitable building materials including in addition to concrete, such materials as metals, plastics, resins, etc.

Figure 27:
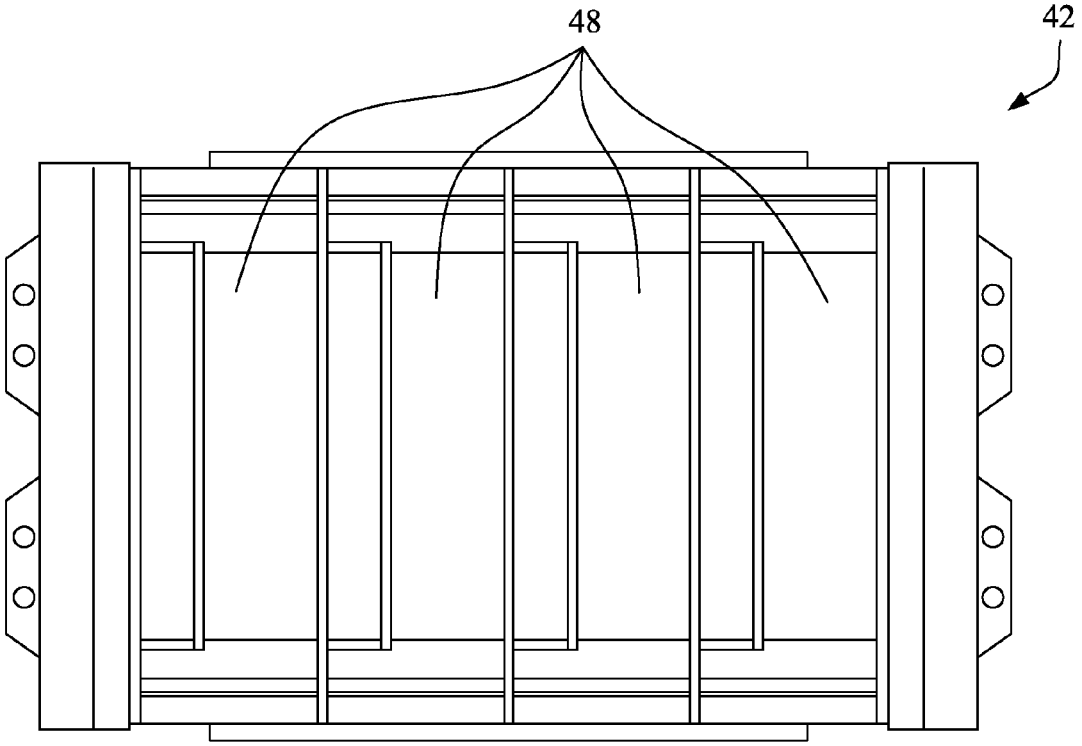
FIG. 27 shows the mold assembly in a mold box.

Turning now to FIGS. 9-24, examples of mold assemblies that may be used to form the above-described block 10 are illustrated. The mold and stripper shoe components as described below may be used in otherwise conventional block manufacturing machines available from, for example, Besser Mfg. Co.; Colombia Machine Co.; Hess Machinery, LTD; Hess Maschinenfabrik GMBH & Co.; Tiger International Inc.; and Tiger Machine Co. Ltd. Other companies may also provide similar machines or components for such machines. A mold assembly 48 designed especially for the block 10 may include a core 50, an outside division plate 54, an inside division plate 52, and a pair of end liners (not shown) bolted together in a mold box 42 (see FIG. 27, four mold assemblies 48 shown in the mold box 42). The plunger (or stripper head) 56 and stripper shoe assembly 58 are bolted together and attached to a stripper head plate (not shown) that enables the plunger 56 and stripper shoe assembly 58 to move down into the mold box. Cut-outs 59 (FIG. 11) in the plunger or stripper head 56 allow the plunger or stripper head to pass through the mold to strip the finished block out of the mold. The stripper shoe assembly includes the stripper bar 58A and blocks 58B at opposite ends of the bar 58A. The bar 58A and blocks 58B are adapted to be bolted to the bottom of the plunger head 56 in the orientation shown in FIG. 9, with spaces provided between the bar 58A and blocks 58B for passing between the return flanges 61 on the core 50 described further below. The core 50 includes a laterally extending, vertically-oriented plate portion 60, with the return flanges 61 secured at opposite ends thereof, and a core block portion 62 shaped to form the angled wall portion 20 of the block 10 and inside surfaces of the side walls 14 and 16. The core 50 is attached to one of the two division plates 52 or 54. For example, if core 50 is attached to outside division plate 54, return flanges 61 will touch or attach to inside division plate 52. This orientation would be reversed if the core 50 were attached to the inside division plate 52.

Figure 9:
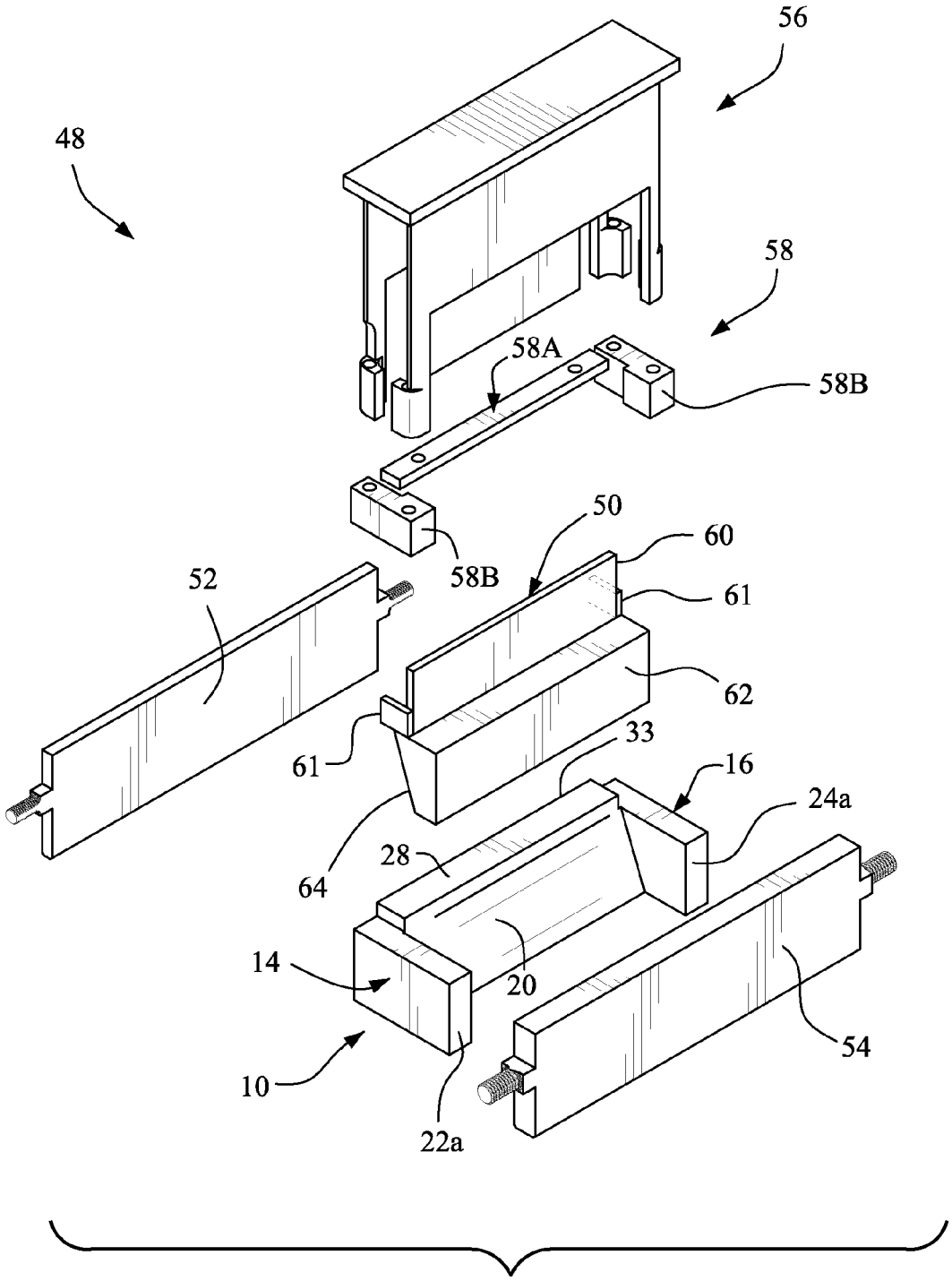
FIG. 9 is an exploded perspective view of a mold core, division plate and stripper shoe assembly used in the production of blocks as shown in FIGS. 1-8.

With continued reference to FIG. 9, the mold assembly provides for machine molding a ventilated building block. The resulting block is cooperable with an adjacent building block of identical construction in a stacked, inverted and reversed orientation relative to the adjacent building block. In one construction of the mold, the outside division plate 54 delimits one of a rearmost side and a forwardmost side of the building block. The inside division plate 52 delimits one of the rearmost side and the forwardmost side of the building block. In the arrangement shown in FIG. 9, the inside division plate 52 delimits the other of the rearmost side and the forwardmost side of the building block. The core block portion 62 is disposed between the outside division plate 54 and the inside division plate 52. The core block portion 62 delimits the sloped front surface 20 of the elongated center portion 12. The plate portion 60 is cooperable with the core block portion 62 and disposed spaced from the one of the outside division plate 54 or the inside division plate 52 that delimits the rearmost side 18 of the building block. The plate portion 60 delimits a thickness of the center portion 12 where the center portion projects upwardly beyond the upper edges of the side walls 14, 16. The return flanges 61 are positioned on opposite lateral sides of the core block portion 62. The pair of return flanges 61 delimit a width of the center portion 12 where the center portion projects upwardly beyond the upper edges of the sidewalls 14, 16. The stripper shoe assembly 58 is disposed outside of and above the return flanges 61 and delimits the upper edges of the side walls 14, 16 and a height of the center portion 12.

The stripper shoe assembly 58 includes the stripper bar 58A and blocks 58B. The blocks 58B are positioned at opposite lateral ends of the stripper bar 58A and are oriented relative to the stripper bar such that the stripper shoe assembly 58 defines a U-shape. The stripper bar 58A delimits a height of the center portion 12, and the blocks 58B delimit the upper edges of the side walls 14, 16. The plunger 56 to which the stripper shoe assembly 58 is bolted is displaceable relative to the outside division plate 54 and the inside division plate 52.

The core block portion 62 and the plate portion 60 may be shaped and positioned relative to each other such that the sloped front surface 20 of the elongated center portion 12 transitions to the vertical wall portion 21 substantially where the elongated center portion 12 projects upwardly beyond the upper edges of the side walls 14, 16. The core block portion 62 and the plate portion 60 may be shaped and positioned relative to each other such that the sloped front surface 20 of the elongated center portion 12 extends from a bottom of the elongated center portion to a top of the elongated center portion (shown in dashed line in FIG. 8). The return flanges 61 may be positioned relative to the core block portion 62 and the stripper shoe assembly 58 such that the elongated center portion 12 is offset inwardly from the side walls 14, 16.

Figure 10:
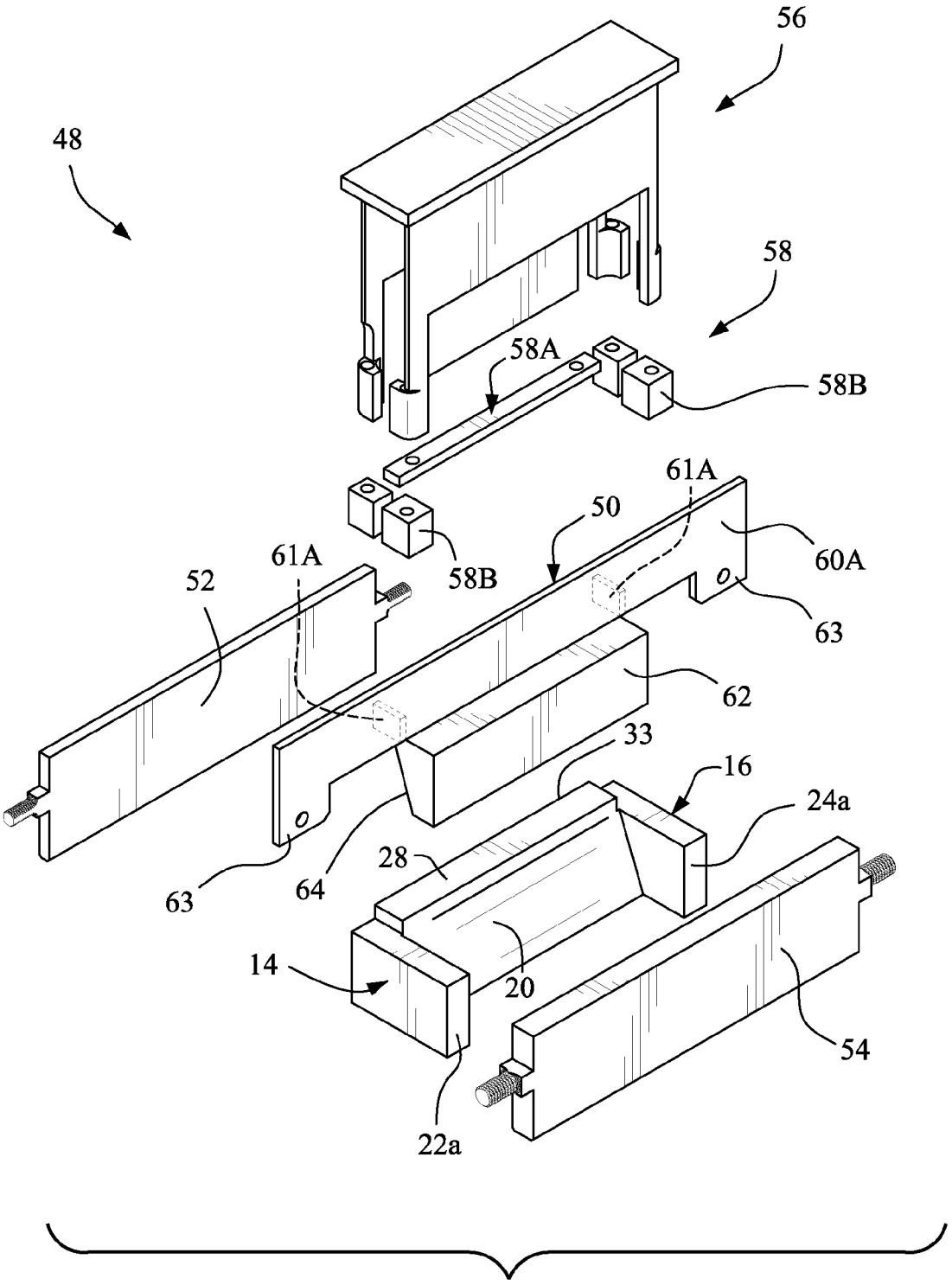
FIG. 10 is an exploded perspective view of an alternative mold core and stripper shoe assembly.

FIG. 10 illustrates an alternative embodiment where the stripper shoe assembly blocks 58B are each comprised of two discrete block elements, separately attachable to the underside of the plunger head 56. In addition, the vertically-oriented core plate portion 60A extends laterally beyond the opposite side edges of the core block portion 62 and is formed with depending flange portions 63. The return flanges 61A remain in the same relative locations as return flanges 61 in the FIG. 9 embodiment.

Figure 11:
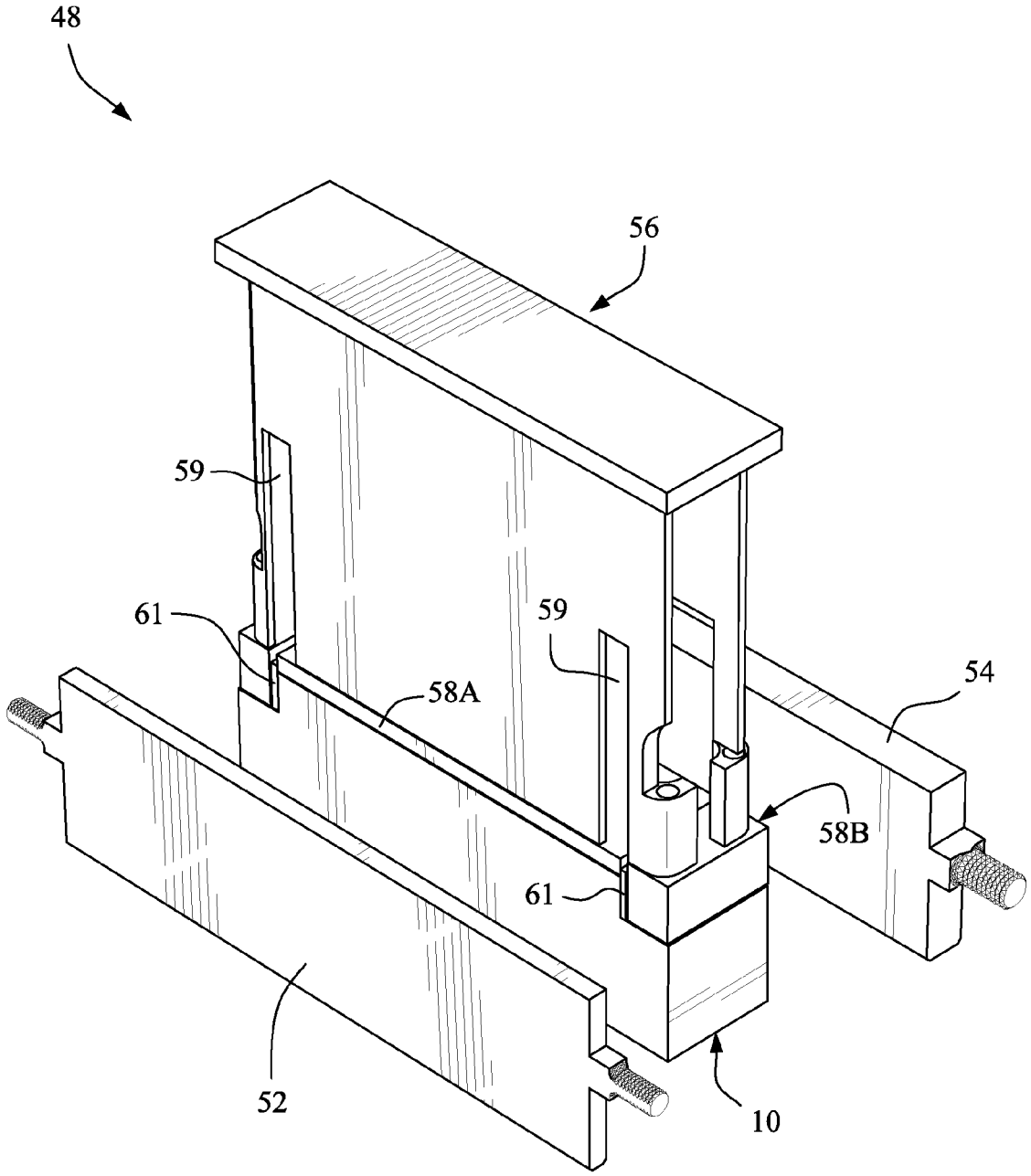
FIG. 11 is a perspective view of the mold assembly of FIG. 9 in partially assembled form, but with the mold core not visible in this view.
Figure 12:
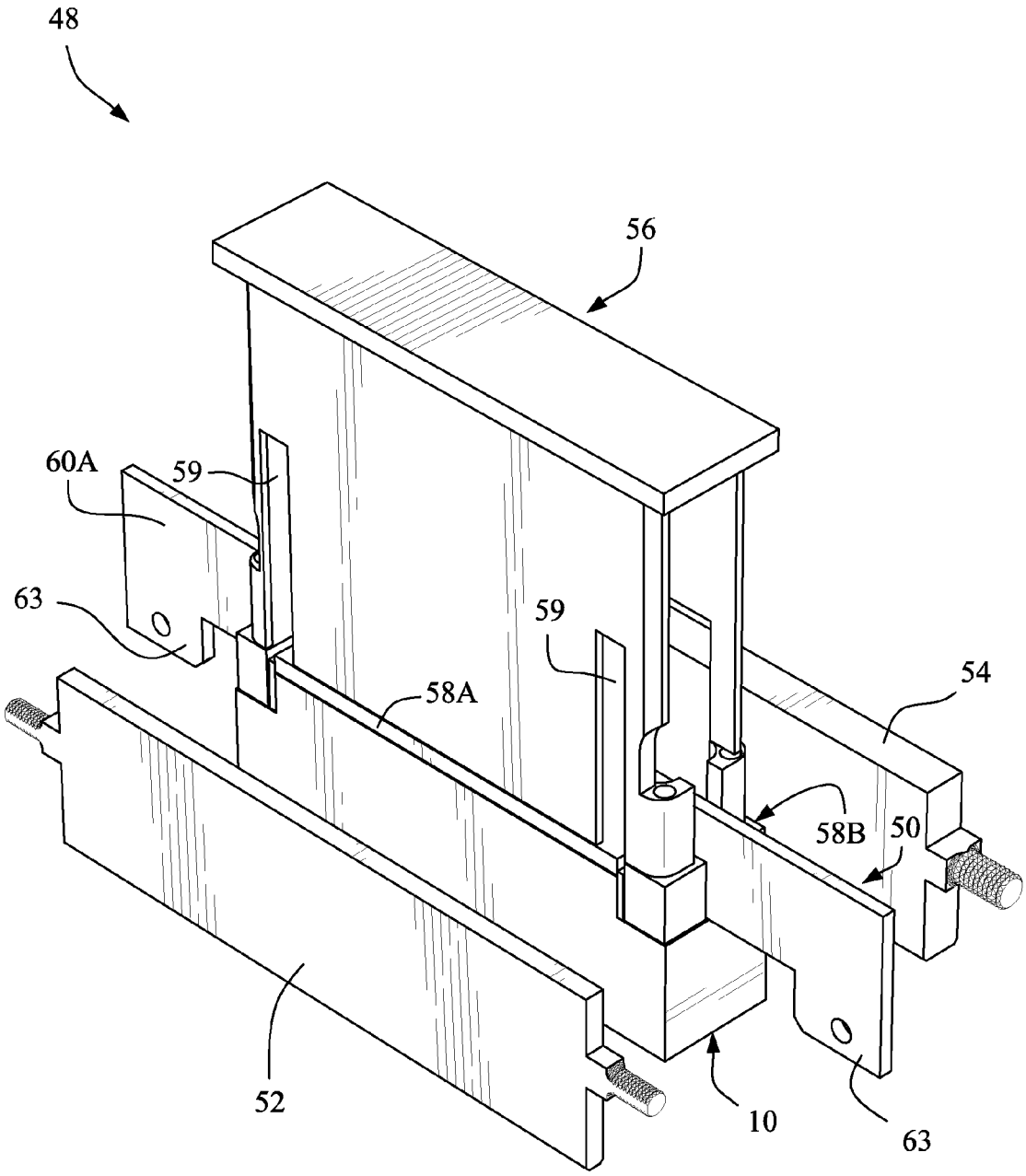
FIG. 12 is a perspective view of the mold assembly of FIG. 10 in partially assembled form but with the mold core not visible in this view.

FIG. 11 illustrates the plunger head 56, stripper shoe assembly and block 10 as shown in FIG. 9 after molding of the block 10 and separation from the division plates 52, 54. FIG. 12 is a view similar to FIG. 11 but showing the components as described in connection with FIG. 10 in the same state.

Figure 13:
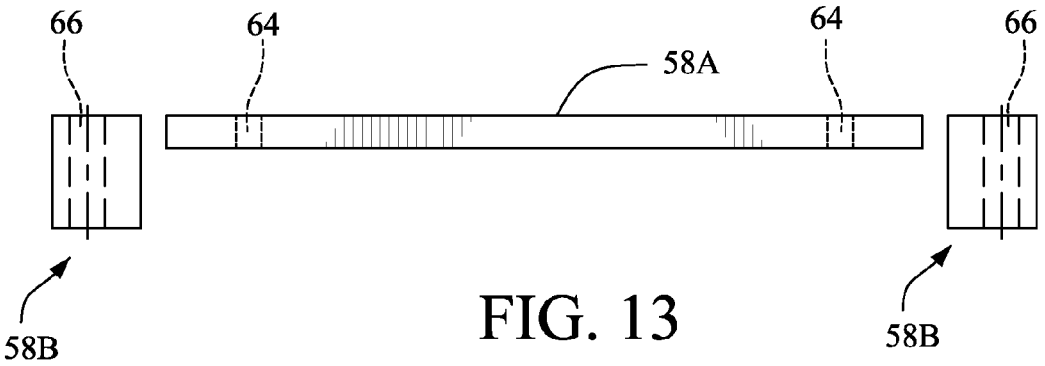
FIG. 13 is a front plan view of stripper shoe components taken from FIG. 9.
Figure 14:
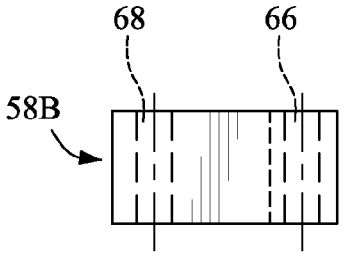
FIG. 14 is an end view of the left-side component in FIG. 13.
Figure 15:
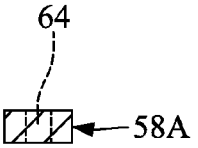
FIG. 15 is a section view taken along the line 15-15 in FIG. 16.
Figure 16A:
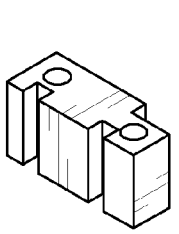
FIG. 16A is a perspective view of an alternative end shoe for a stripper assembly.
Figure 16:
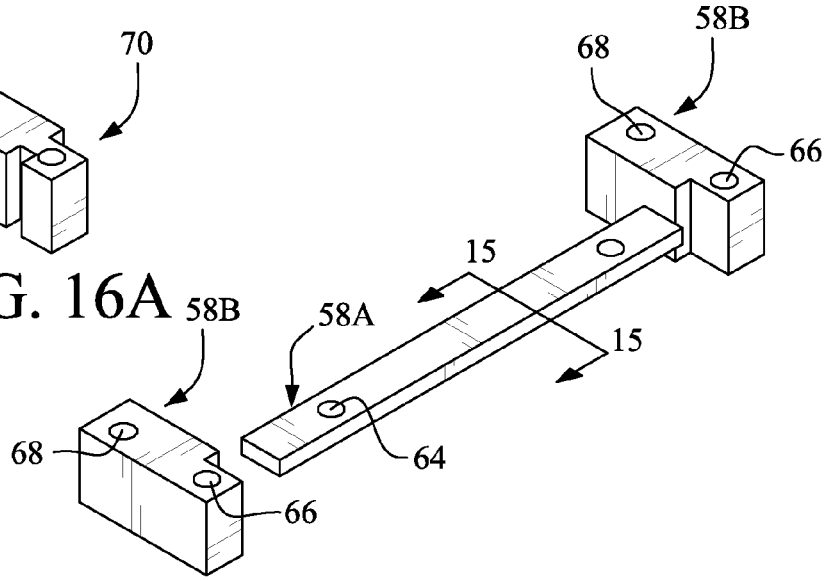
FIG. 16 is a perspective view of the stripper shoe subassembly shown in FIGS. 13-15.
Figure 17:
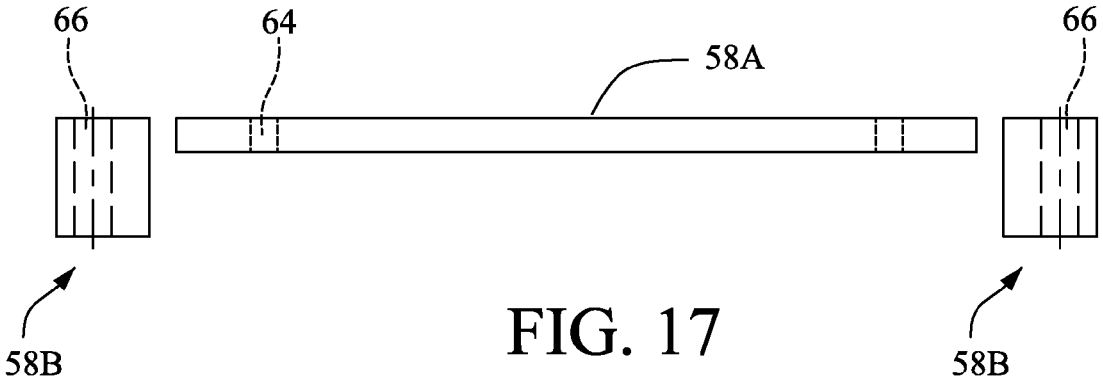
FIGS. 17-20 are views similar to FIGS. 13-16 but in accordance with an alternative stripper-shoe assembly embodiment.
Figure 18:
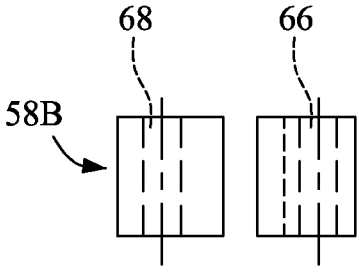
Figure 19:
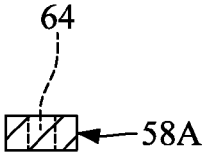
Figure 20:
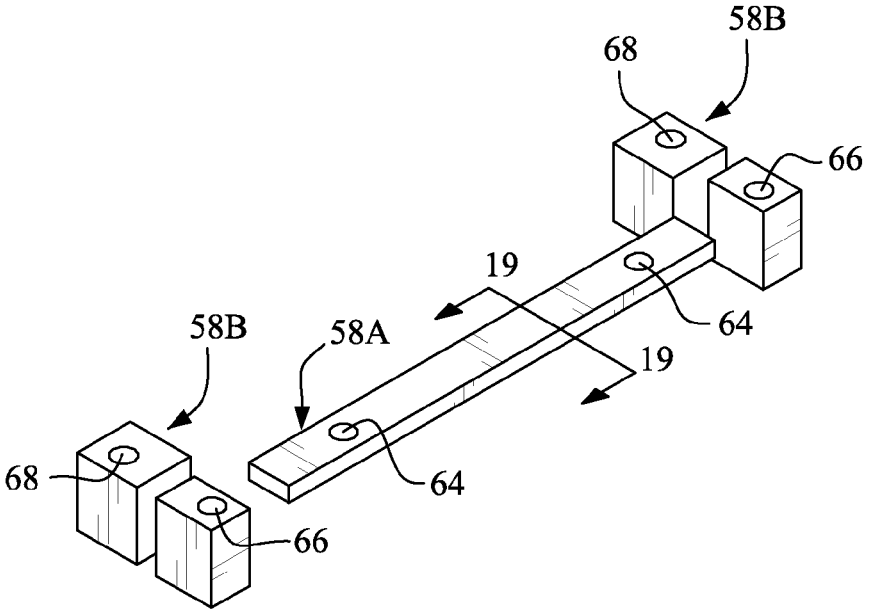

FIGS. 13-16 show the stripper shoe components of FIG. 9. Specifically, the bar 58A includes attachment holes 64, and end blocks 58B are each provided with attachment holes 66, 68 for securing these components to the underside of the plunger 66. As shown in FIG. 13, the bar 58A may comprise a planar plate member that is thinner than the end blocks 58B. The bar 58A may be generally rectangular in cross-section. FIG. 16A shows an alternative end shoe 70 for the stripper assembly that fits with a grooved end liner (not shown).

FIGS. 17-20 show the alternative stripper shoe components from FIG. 10. In this embodiment, the center bar 58A remains the same (including attachment holes 64), but the end blocks 58B are divided into two discrete elements provided with respective attachment holes 66, 68. The division of the end blocks accommodates the longer core plate portion 60A of FIG. 10.

Figure 21:
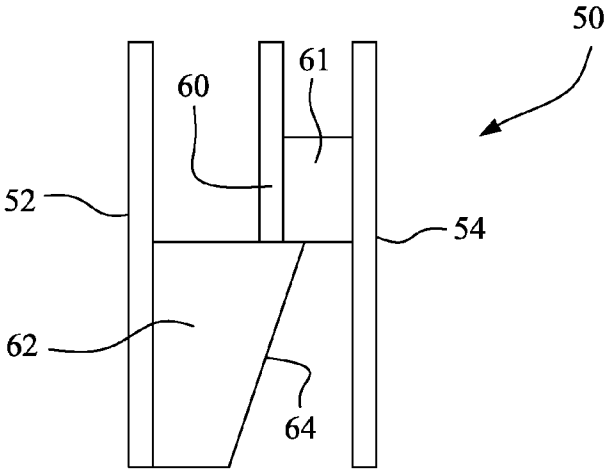
FIG. 21 is a left end view of the core and division plates taken from FIG. 9, but shown in assembled relationship.
Figure 22:
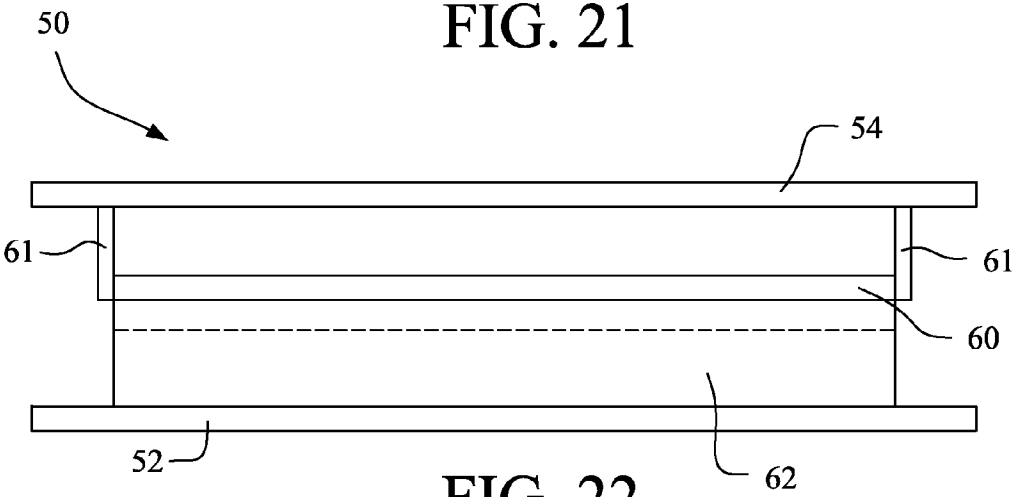
FIG. 22 is a plan view of the components shown in FIG. 21.

FIGS. 21 and 22 illustrate the core assembly of FIG. 9 in place, ready for molding, with division plates 52, 54 defining the width dimension of the block 10 to be molded. As indicated above, the arrangement of core components relative to the division plates 52, 54 may be reversed.

Figure 23:
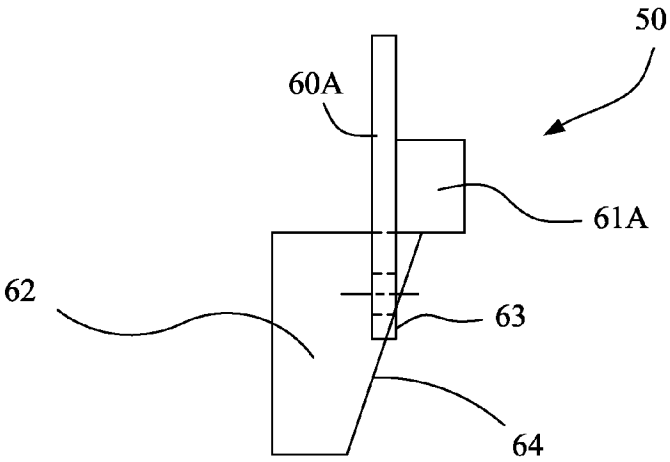
FIG. 23 is a left end view of the mold core components shown in FIG. 10.
Figure 24:
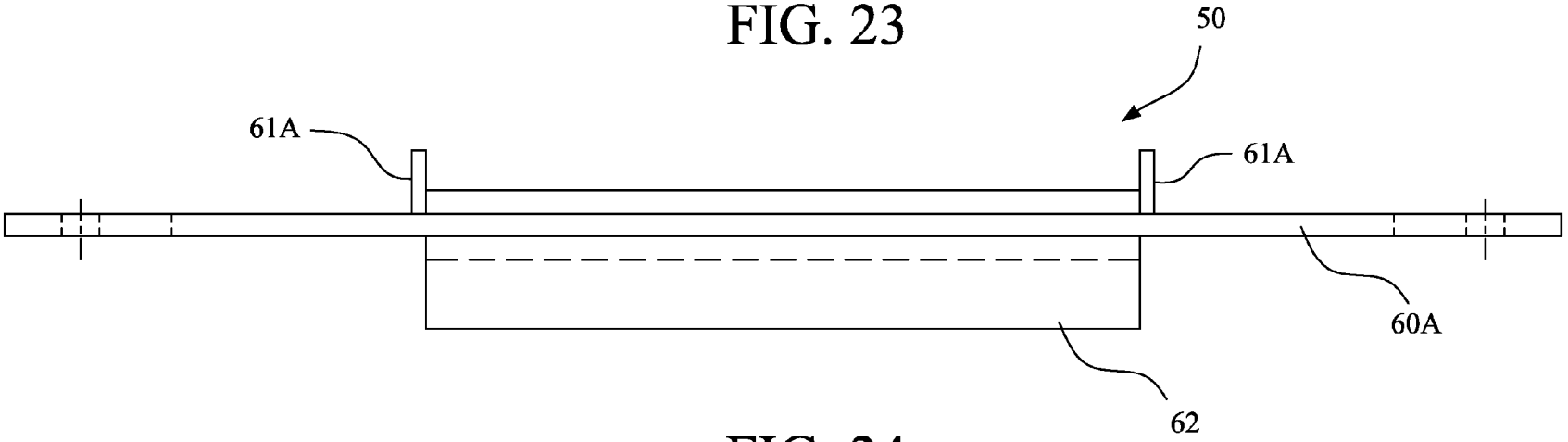
FIG. 24 is a plan view of the mold core components as shown in FIG. 23.

FIGS. 23 and 24 show similar views as shown in FIGS. 21 and 22, but with the alternative core components shown in FIG. 10, and with the division plates removed.

Figure 25:
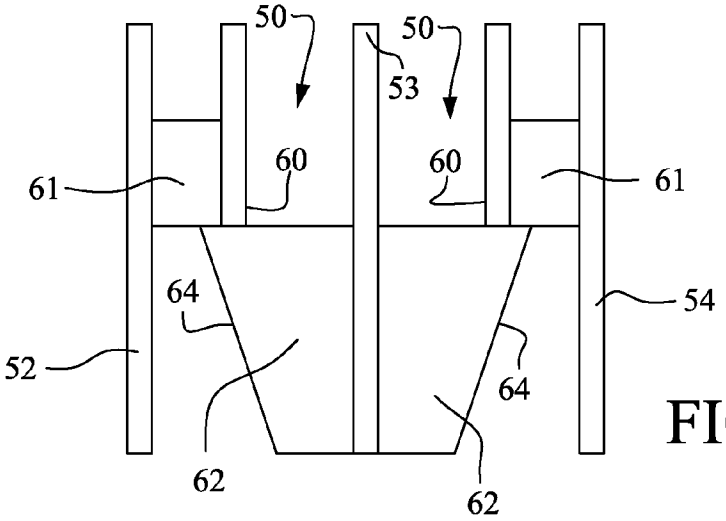
FIG. 25 is an end elevation of a mold core and division plate assembly in accordance with another exemplary embodiment.
Figure 26:
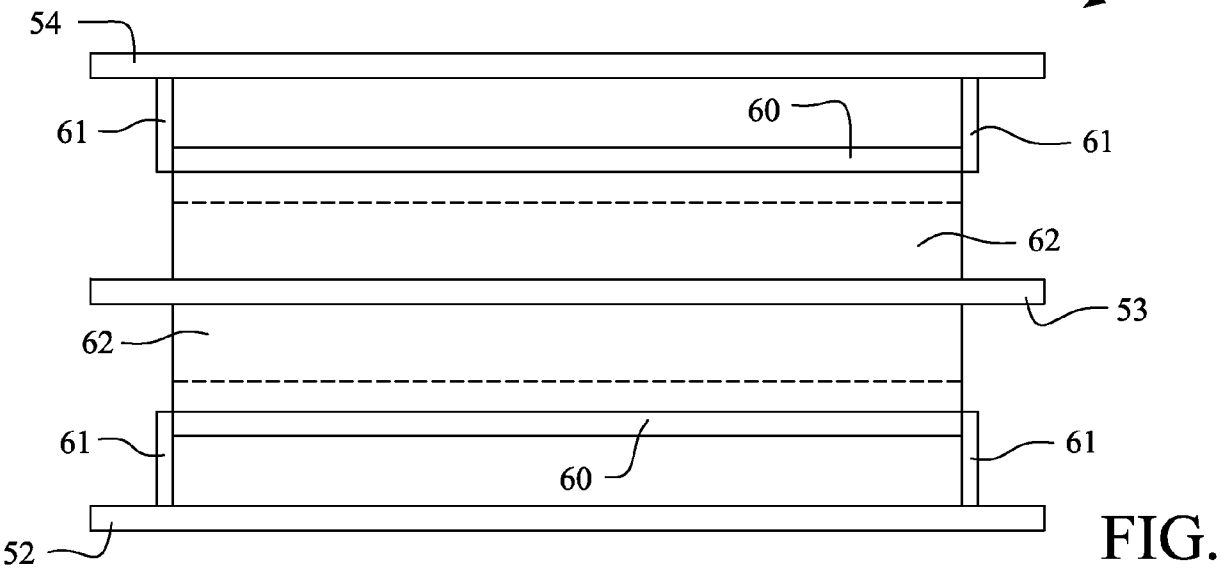
FIG. 26 is a plan view of the mold core and division plate assembly as shown in FIG. 25.

FIGS. 25 and 26 show similar views of the mold core as shown in FIGS. 21 and 22, but with a pair of core assemblies in back-to-back orientation, enabling simultaneous molding of a pair of blocks 10. This arrangement requires the addition of a third or center division plate 53 separating the core block portions 62. The plate 53 is similar to plates 52, but with core portions attached to both sides of the plate. The center division plate 53 is interposed between the outside division plate 54 and the inside division plate 52 and defines two mold chambers for concurrently molding two building blocks. In the embodiment shown, the center division plate 53 is interposed between two core block portions 62 of the respective mold chambers. In this arrangement, the center division plate 53 thus delimits the forwardmost side of each of the building blocks in the respective mold chambers. Both the outside division plate 54 and the inside division plate 52 are thus positioned to delimit the rearmost side of each of the building blocks.

For all embodiments, it will be appreciated that the dimensions of the core and stripper components may vary depending on the dimensions of the finished block 10. The core plate portion 60 or 60A may be placed anywhere on the upper edge of the core block portion 50, and return flanges 61 or 61A may vary in both length and height.

As well understood by those familiar with the Besser and Columbia machines, in the block manufacturing process, a pallet plate (not shown) is moved into position below the mold box 42, and concrete is poured into the box. The mold box 42 is vibrated to settle and uniformly distribute the concrete, and then the plunger head 56 and stripper shoe assembly 58 as described herein will be moved into the box to compress the concrete while under vibration, within the confines of the inner and outer division plates 52, 54, end liners (not shown) and about the core 50. After the block 10 has been formed, it will be stripped from the mold by removing the pallet, enabling the stripper shoe and plunger head to push the finished product out of the mold box.

Figure 28:
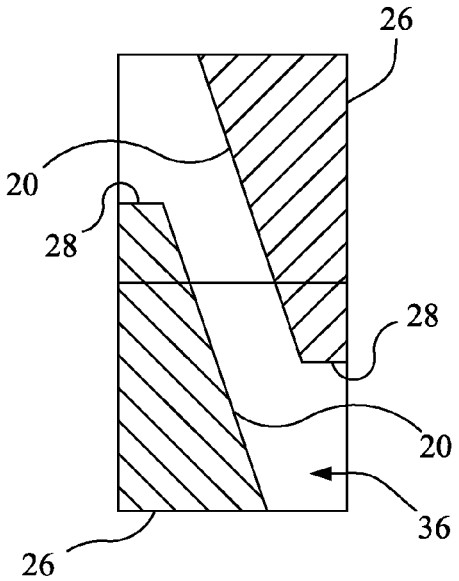
FIG. 28 shows adjacent blocks oriented for constructing a wall.
Figure 29:
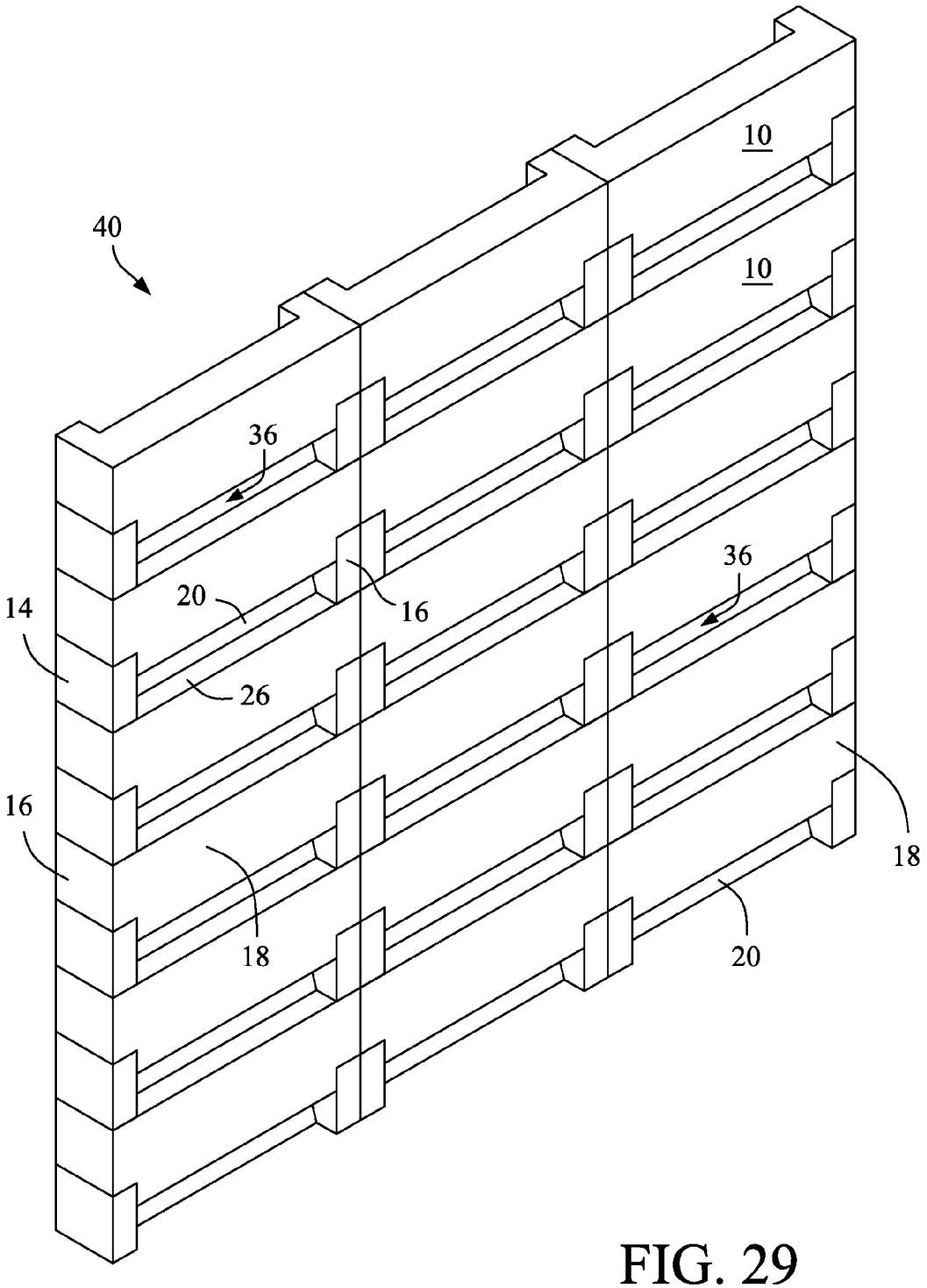
FIG. 29 shows a wall constructed with the ventilated building blocks of the preferred embodiments.

FIG. 28 shows adjacent blocks oriented for constructing a wall, and FIG. 29 shows a wall constructed with the ventilated building blocks. A finished building block is cooperable with an adjacent building block of identical construction in a stacked, inverted and reversed orientation relative to the adjacent building block. The front faces 20 of inverted and reverse oriented blocks define a ventilation passage 36 through the block pair. As shown, the ventilation passage 36 is oriented from an outside surface of the block pair (on the right side in FIG. 28) upward and inward to an inside surface of the block pair (on the left side in FIG. 28) according to the angle of the front faces 20. As shown in FIG. 29, the block pairs can be stacked to form a ventilated wall 40.

While the invention has been described in connection with what is presently considered to be the most practical and preferred embodiments, it is to be understood that the invention is not to be limited to the disclosed embodiments, but on the contrary, is intended to cover various modifications and equivalent arrangements.

The invention claimed is:

1. A mold assembly for machine molding a ventilated building block, the building block being cooperable with an adjacent building block in a stacked, inverted and reversed orientation relative to the adjacent building block, the building block including an elongated center portion flanked by a pair of substantially parallel side walls oriented substantially perpendicularly to the center portion, the center portion projecting upwardly beyond upper edges of the side walls, and the side walls extending forwardly of a forward edge of the center portion, the mold assembly comprising:

an outside division plate delimiting one of a rearmost side and a forwardmost side of the building block;

an inside division plate delimiting one of the rearmost side and the forwardmost side of the building block;

a core block portion disposed between the outside division plate and the inside division plate, the core block portion being sloped to delimit a sloped front surface of the elongated center portion;

a plate portion cooperable with the core block portion and disposed spaced from the one of the outside division plate or the inside division plate that delimits the rearmost side of the building block, the plate portion delimiting a thickness of the center portion where the center portion projects upwardly beyond the upper edges of the side walls;

a pair of return flanges positioned on opposite lateral sides of the core block portion, the pair of return flanges being spaced from each other to delimit a width of the center portion where the center portion projects upwardly beyond the upper edges of the side walls; and a stripper shoe assembly disposed outside of and above the return flanges, the stripper shoe assembly delimiting the upper edges of the side walls and a height of the center portion, wherein the return flanges are positioned relative to the core block portion and the stripper shoe assembly and spaced from each other such that the elongated center portion of the building block that projects upwardly beyond the upper edges of the side walls is offset inwardly from an inner side of the side walls.

2. A mold assembly according to claim 1, wherein the plate portion extends laterally beyond opposite side edges of the core block portion.

3. A mold assembly according to claim 1, wherein the stripper shoe assembly comprises:

a stripper bar positioned adjacent the core block portion and delimiting the height of the center portion; and blocks positioned at opposite lateral ends of the stripper bar and oriented relative to the stripper bar such that the stripper shoe assembly defines a U-shape, the blocks delimiting the upper edges of the side walls.

4. A mold assembly according to claim 3, further comprising a plunger to which the stripper shoe assembly is bolted, the plunger being displaceable relative to the outside division plate and the inside division plate.

5. A mold assembly according to claim 4, wherein each of the blocks comprises two discrete block elements separately attachable to an underside of the plunger.

6. A mold assembly according to claim 3, wherein the stripper bar comprises a planar plate member that is thinner than the blocks, wherein the bar is generally rectangular in cross-section.

7. A mold assembly according to claim 1, further comprising a plunger to which the stripper shoe assembly is bolted, the plunger being displaceable relative to the outside division plate and the inside division plate.

8. A mold assembly according to claim 7, further comprising cutouts in the plunger that allow the plunger to pass through the mold assembly to strip a finished block out of the mold.

9. A mold assembly according to claim 1, wherein the core block portion and the plate portion are shaped and positioned relative to each other such that the sloped front surface of the elongated center portion of the building block machine molded by the mold assembly transitions to a vertical wall portion substantially where the elongated center portion projects upwardly beyond the upper edges of the side walls.

10. A mold assembly according to claim 1, wherein the core block portion and the plate portion are shaped and positioned relative to each other such that the sloped front surface of the elongated center portion of the building block machine molded by the mold assembly extends from a bottom of the elongated center portion to a top of the elongated center portion.

11. A mold assembly for machine molding a ventilated building block, the building block being cooperable with an adjacent building block in a stacked, inverted and reversed orientation relative to the adjacent building block, the building block including an elongated center portion flanked by a pair of substantially parallel side walls oriented substantially perpendicularly to the center portion, the center portion projecting upwardly beyond upper edges of the side walls, and the side walls extending forwardly of a forward edge of the center portion, the mold assembly comprising:

an outside division plate delimiting one of a rearmost side and a forwardmost side of the building block;

an inside division plate delimiting one of the rearmost side and the forwardmost side of the building block;

a core block portion disposed between the outside division plate and the inside division plate, the core block portion delimiting a sloped front surface of the elongated center portion;

a plate portion cooperable with the core block portion and disposed spaced from the one of the outside division plate or the inside division plate that delimits the rearmost side of the building block, the plate portion delimiting a thickness of the center portion where the center portion projects upwardly beyond the upper edges of the side walls;

a pair of return flanges positioned on opposite lateral sides of the core block portion, the pair of return flanges delimiting a width of the center portion where the center portion projects upwardly beyond the upper edges of the side walls;

a stripper shoe assembly disposed outside of and above the return flanges, the stripper shoe assembly delimiting the upper edges of the side walls and a height of the center portion; and a center division plate interposed between the outside division plate and the inside division plate, the center division plate defining two mold chambers for concurrently molding two building blocks.

12. A mold assembly according to claim 1, wherein the inside division plate delimits the other of the rearmost side and the forwardmost side of the building block.

13. A ventilated building block manufactured using the mold assembly according to claim 1.

* * * * *